US005899044A

United States Patent [19]

Jarrett

[11] Patent Number: 5,899,044

[45] Date of Patent: May 4, 1999

[54] POST ENCLOSURE

[75] Inventor: Mark G. Jarrett, St. Clair Shores, Mich.

[73] Assignee: Hollowood, Inc., Clinton Township, Mich.

[21] Appl. No.: 08/862,106

[22] Filed: May 22, 1997

Related U.S. Application Data

[60] Provisional application No. 60/018,118, May 22, 1996.

[51] Int. Cl.[6] ..... E04C 3/36

[52] U.S. Cl. ..... 52/737.4; 52/737.3; 52/738.1; 52/730.7; 52/732.3; 52/736.3; 52/745.17; 52/745.18; 52/DIG. 8; 144/380; 156/218; 428/35.6

[58] Field of Search ..... 52/737.1, 737.3, 52/737.4, 738.1, 720.2, 721.4, 723.1, 724.5, 730.7, 731.4, 732.3, 736.3, 745.17, 745.18, DIG. 8, DIG. 14; 144/42, 349, 351, 380; 156/123, 218, 304.2, 466; 428/35.6

[56] References Cited

U.S. PATENT DOCUMENTS

| | | | |
|---|---|---|---|
| 681,693 | 9/1901 | Goldenbogen | 52/731.4 |
| 792,005 | 6/1905 | Coburn | 144/346 |
| 833,263 | 10/1906 | Tracy | 52/DIG. 8 |
| 834,391 | 10/1906 | Manning | 52/721.4 |
| 1,133,106 | 3/1915 | Cuppett | 52/783.1 |
| 1,346,161 | 7/1920 | Basquin | 144/380 |
| 1,350,686 | 8/1920 | Trudelle | 52/737.4 X |
| 2,026,698 | 1/1936 | Nelson | 156/218 |
| 2,505,789 | 5/1950 | Norquist | 52/631 |
| 3,200,554 | 8/1965 | Goodman et al. | 52/736.3 X |
| 3,277,624 | 10/1966 | Cornell | 52/DIG. 8 |
| 3,614,967 | 10/1971 | Royston | 156/304.2 X |
| 3,917,333 | 11/1975 | Grattan | 294/1.3 |
| 3,963,546 | 6/1976 | Roberti | 144/380 X |
| 3,970,401 | 7/1976 | Lubeck | 52/737.3 X |
| 4,035,978 | 7/1977 | Bajorek et al. | 52/732.3 X |
| 4,038,802 | 8/1977 | Bajorek et al. | 52/720.2 |
| 4,606,167 | 8/1986 | Thorne | 52/737.4 |
| 4,961,258 | 10/1990 | Menzel | 52/745.17 |
| 5,438,812 | 8/1995 | Erickson | 52/DIG. 8 |
| 5,458,942 | 10/1995 | Miller | 52/738.1 X |
| 5,553,433 | 9/1996 | Lang | 52/DIG. 8 |
| 5,568,709 | 10/1996 | Steckler | 52/745.17 X |

OTHER PUBLICATIONS

"Reynolds Aluminum Colonial Columns", Brochure from Reynolds Metals Company, Jan. 1973.

*Primary Examiner*—Carl D. Friedman
*Assistant Examiner*—Laura A. Callo
*Attorney, Agent, or Firm*—Gifford, Krass, Groh, Sprinkle, Anderson & Citkowski, P.C.

[57] ABSTRACT

A tubular cover or metal support members has been provided in which the tubular cover member is made of multiple layers of material such as wood veneer and in which all of the layers are severed to form a slit to extend longitudinally of the tube and in which a hinge point is formed diametrically opposite to the slit by severing all except the outer layer of material. In one embodiment, the hinge is reinforced with a sheet of inorganic material. Applying the tube to the support member entails opening the cover to place it on the support member and fastening the opposite edges of the slit to each other to make a permanent enclosure for the support member.

8 Claims, 3 Drawing Sheets

POST ENCLOSURE

This application claims the benefit of U.S. Provisional application Ser. No. 60/018,118 filed May 22, 1996.

This invention relates to wooden tubes and more particularly to a wooden the construction and method of applying the tube to cover a metal support post which has already been installed.

Many residential buildings have basements in which horizontal support beams are supported at intervals by vertical steel posts. Such posts are unsightly particularly if the area is to be used as a recreational room or den. Usual methods of concealing such posts such as by paint, wallpaper or boxing in the posts are rarely adequate.

The present invention makes it possible to enclose the post in a wooden tube so that the post is concealed and the natural wood grain can be utilized for decorative aspects.

Wood tubes have recently become available in which the tubes are made up of separate layers of veneer with grain in a first layer extending longitudinally of the tube and grain, and an adjacent layer extending circumferentially or transversely to the grain of the first layer. Tubes of this form can be made up of three or more layers and are available in diameters ranging from one half to four inches or more and in lengths of eight feet or more. Other wood tubes are referred to in the prior art which are made up by winding a continuous assembly of veneer pieces into a spiral roll. The present invention is applicable to either type of tube.

The wood tube covering of the present invention is in the form of a multi-layered wooden tube split through all of its layers longitudinally of the tube and through all except one or more layers at a hinge point located diametrically opposite to the first mentioned split. This makes it possible to open the tube about its hinge point to apply the tube as a covering to support posts which have already been installed and in which both ends are obstructed.

Preferred embodiments of the invention will be best understood by reference to the drawings in which.

Figure 1:
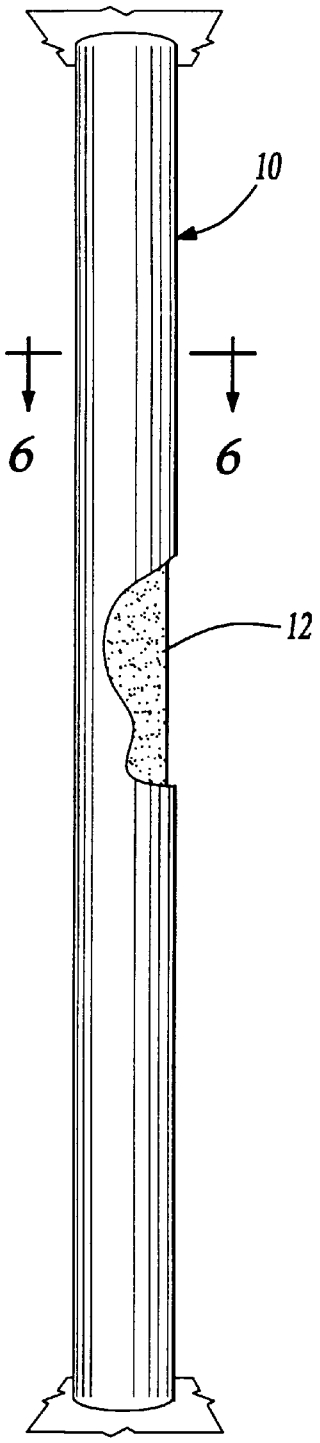
FIG. 1 is an elevation of the wood post in position with parts of the wooden post broken away to illustrate the concealed metal support post.

The wood tube enclosure embodying the present invention is designated generally at 10 and its purpose is to cover structural support posts such as the one indicated at 12 in FIG. 1. The tubular enclosure 10 can be made up of a plurality of layers of wood veneer designated at 14, 16, 18 and 20 in FIG. 3 which are bonded together by adhesive or resin. Preferably the wood grain in the outer layer 14 of the tubular enclosure has the veneer grains extending longitudinally of the tube.

Figure 6:
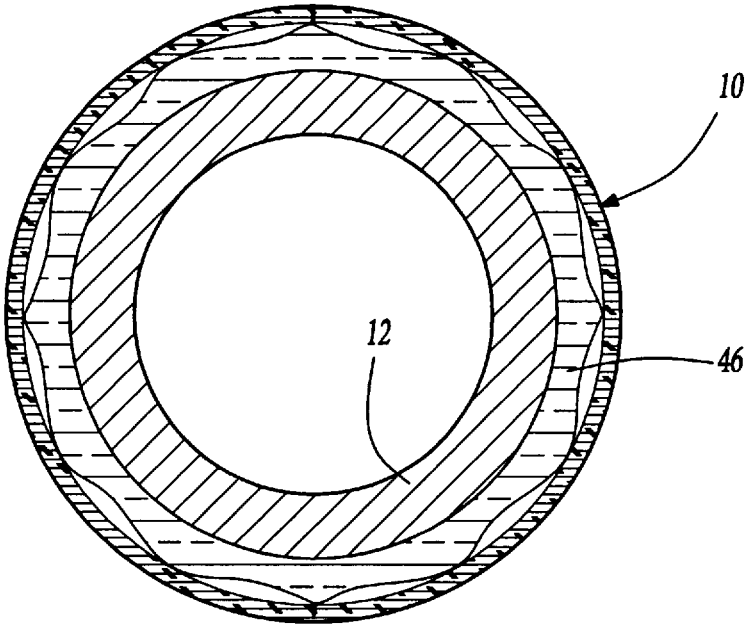
FIG. 6 is a cross-sectional view taken on line 6—6 in FIG. 1.

The tubular enclosure 10 is made up of a tube having a length substantially equal to the support post 12 to be covered. As seen in FIG. 6, the tube 10 is cut to form a slit 22 extending for the full length of the tube and completely severing each of the layers 14 through 20. At the same time, the tube 10 is cut to form a slit 24 which extends the full length of the tube 10 and severs the inner three layers of veneer 16, 18 and 20 leaving the adjacent portion of the exterior layer of veneer 14 to form a hinge area indicated at 26.

Figure 3:
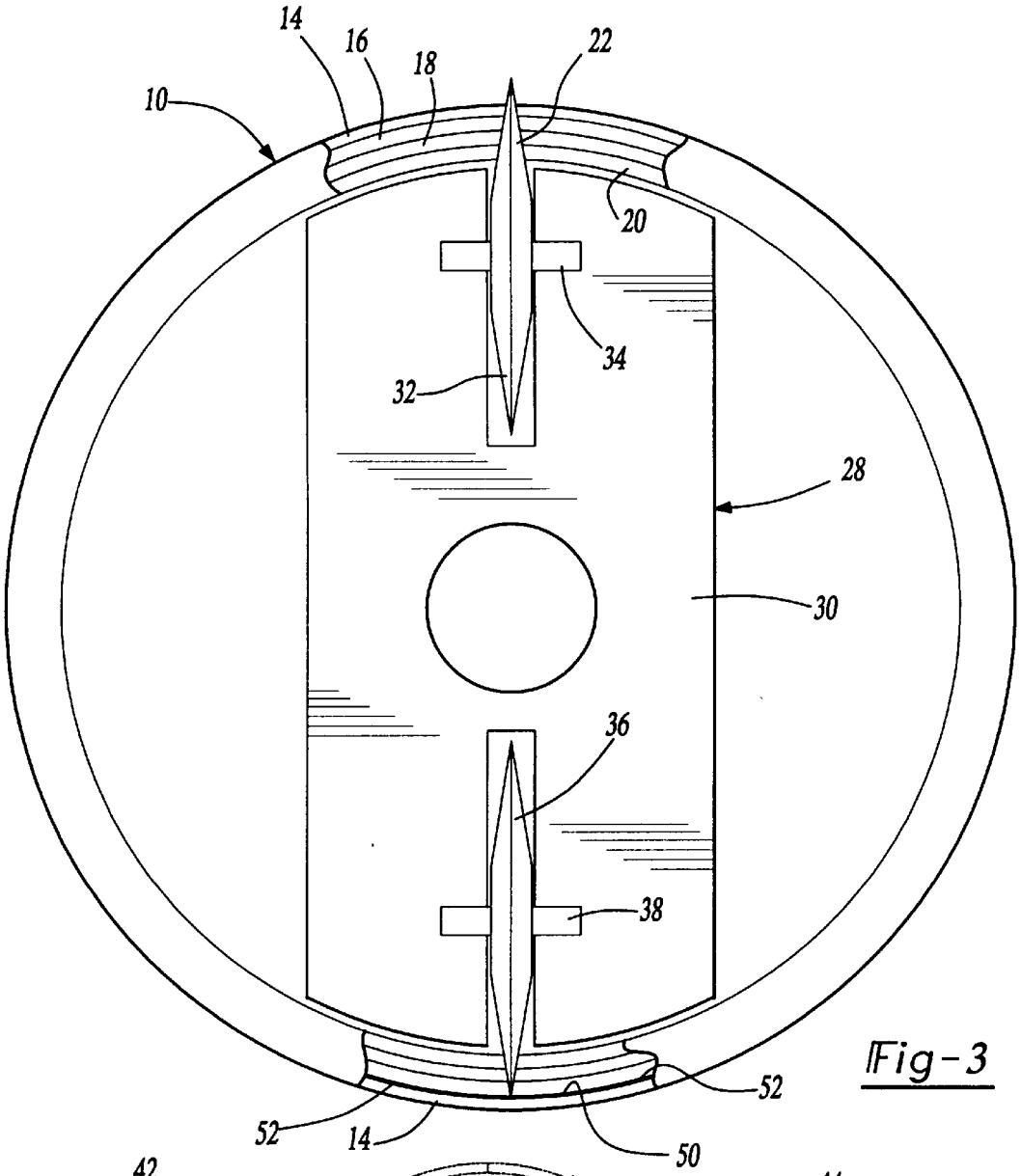
FIG. 3 is an enlarged cross-sectional view illustrating the tool employed in modifying the wooden tube for hinging purposes.

The tool by which the tube 10 is formed or slit to permit opening, is illustrated at 28, in FIG. 3. The tool 28 includes a support member 30 having a cutting disk 32 mounted for rotation about a tangential axle 34 so that the disk protrudes from a side of the support 28 sufficiently to cut completely through veneer layers 14–20. A second cutting disk 36 is disposed diametrically opposite cutting disk 32 and is supported for rotation on a tangential ale 38 so that the disk 36 protrudes only enough to cut through inner layers 16, 18 and 20 but leaves the outer layer 14 intact. The support member 28 is shaped to afford sliding clearance with the internal surface of the tube 10. The tool is used by holding the tube stationary while the tool 28 is pulled longitudinally the entire length of the tube 10 while cutting disks 32 and 36 form the slit 22 and partial slit 24.

Figure 2:
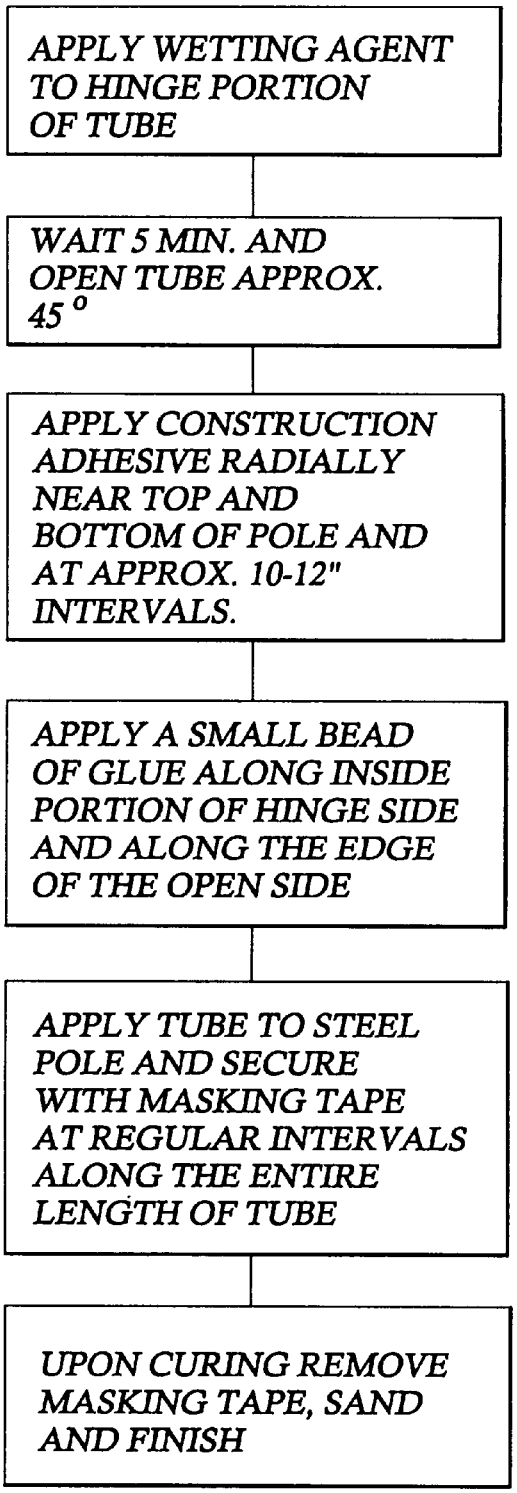
FIG. 2 is a flow diagram illustrating the steps in applying the wooden tube to the vertical support post.
Figure 4:
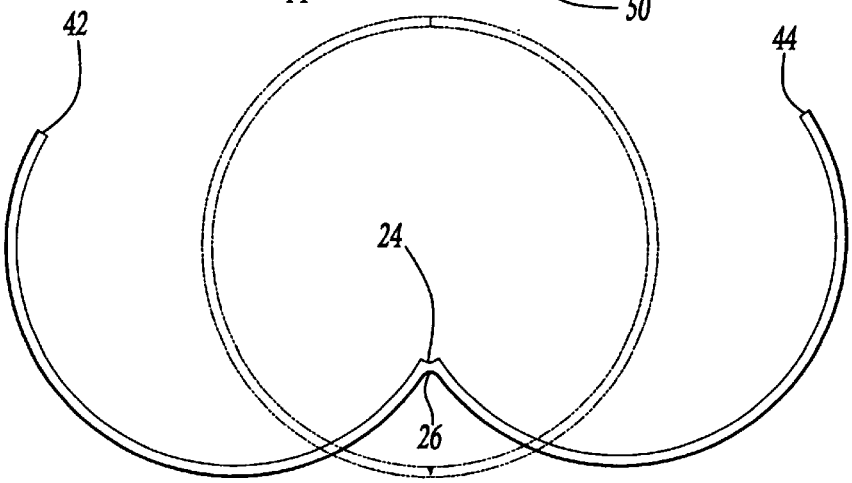
FIG. 4 is a view at a reduced scale illustrating the wooden tube in its closed and in its open position.

The method by which the tubular enclosure 10 is applied to enclose a support post 12 is set forth in FIG. 2 and begins with the application of a liberal coating of wetting agent such as clear water to the hinge area 26 to allow the wood fibers in the outer veneer layer 14 to soften. After allowing the wetted tubular enclosure 10 to absorb water for a sufficient period of time, for example, five to ten minutes, the tubular enclosure 10 can be open, as seen in FIG. 4, to spread the opposite edges 42 and 44 of slit 22, at least enough to form a gap to accept the support post 12.

With the tubular enclosure 10 in its open position, the construction adhesive can be applied circumferentially at axially spaced points as designated at 46 for engagement with the sides of the support post 12 after the tubular enclosure has been applied to the post. At the same time that the construction adhesive is applied, carpenters glue should be applied to the opposed edge surfaces 42, 44 or to the opposed edge surfaces adjacent to the hinge point 26. Thereafter, the tubular enclosure can be placed in position around the post so that the opposed edges 42, 44 engage and are aligned with each other.

It is desirable to apply pressure to the tubular enclosure to insure that the construction adhesive makes good contact between the inside of tube 10 and the support post 12. Care should be taken to insure that the opposed edges 42 and 44 are aligned after which removable tape can be placed to hold the opposed edges 28, 30 in contact with each other until the adhesive sets. After the adhesive has cured, the tape can be removed and the joint formed at the slit 22 can be lightly sanded.

If for any reason the directions for applying the tubular enclosure were not followed so that the veneer in the area of the hinge point 26 fractures, the process of applying the tubular enclosure can continue and carpenters glue can be applied to the fractured areas making sure that opposed edges are perfectly aligned.

Figure 5:
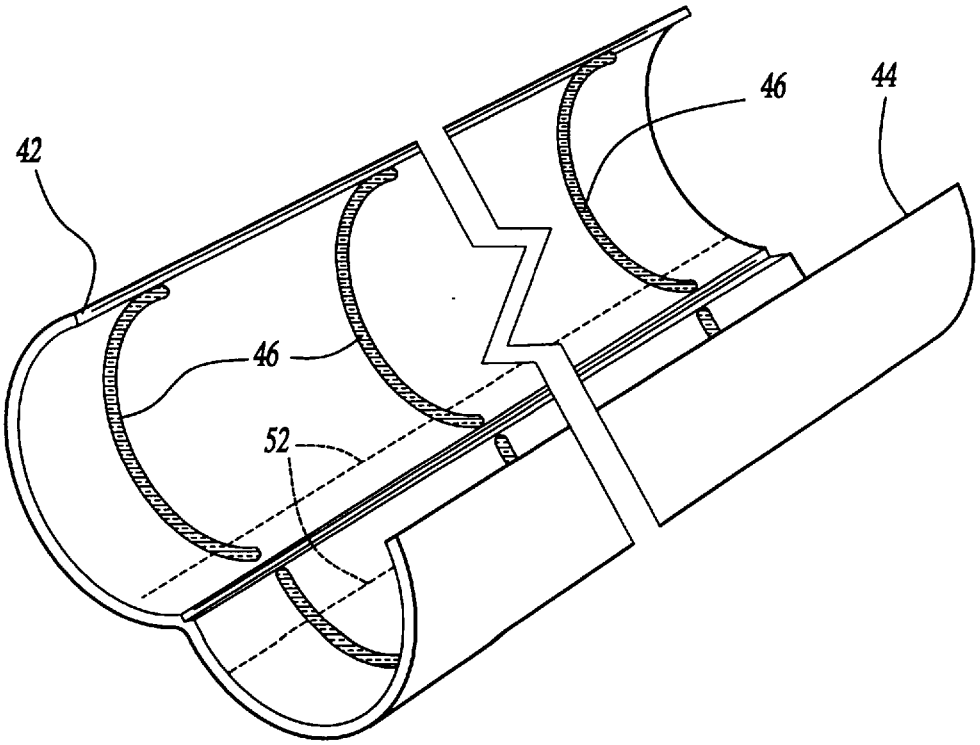
FIG. 5 is a perspective view of the wooden tube shown in its open position with adhesive applied to the inside surfaces.

In another embodiment of the invention, the tube 10 forming the enclosure is modified by positioning a reinforcing layer of material 50 adjacent to the hinge area between the outermost layer of sheet material 14 and the next adjacent layer 16. The reinforcing layer 50 extends the full length of the tube 12 and has a width sufficient to extend to opposite sides of the slit 24 forming the hinge 26 as indicated by the lines depicting the edges of the reinforcing layer at 52 in FIGS. 3 and 5.

The material in the reinforcing layer can he fiberglass cloth or other inorganic material. Other materials which have been found suitable are material called "veil" manufactured by Sterling Paper Co., of Stratford, Connecticut. Still another suitable material is available at most building material suppliers under the name "Tyvek" which is in the form of a sheet material used to envelope buildings to provide a moisture barrier. Any of these materials will permit flexing of the outer layer of veneer at the hinge point 26 without resulting in splitting of the veneer forming the hinge point 26.

In the formation of a tube enclosure and, in particular, in the cutting of the slit 24, care must be taken to insure that the cut progresses through the layers 16, 18 and 20 without severing the reinforcing layer 50 or the outer layer 14.

The reinforcing layer 50 makes it possible to eliminate the step of using a wetting agent such as water on the hinge area 26 prior to opening of the tube for placement on the support member 12. This can be of particular advantage in the case of some woods which may stan from localized wetting. Also, wetting sometimes cause the compressive strength to become severely decreased so that damage is caused the outer layer of veneer by hinging action.

A tubular wooden cover for metal support post has been provided together with a tool and method for forming the cover from a wooden tube. Also provided is the method of applying the wooden tubular cover to a support post which has already been installed.

I claim:

1. A tube enclosure for a support post comprising:

an elongated tube having a wall made up of multiple layers of sheet material, a reinforcing layer of material disposed between an exterior layer and adjacent layer of sheet material, a first continuous slit formed in the wall of said tube and extending the full length of said tube and through all of said layers of material, a hinge formed diametrically opposite to said slit, said hinge being formed by a second continuous slit extending the full length of said tube and extending from an inside of said tube to said reinforcing layer, said first slit being openable to receive the post to be covered by moving opposed portions of said tube about said hinge, and means for bonding the edges of said first slit together after said tube has been placed about a support post.

2. The tube enclosure of claim 1 wherein said reinforcing layer of material is disposed between adjacent layers of said sheet material at the bottom of said second slit and extending to opposite sides of said slit and for the full length of said tube.

3. The combination of claim 1 wherein said layers of sheet material are wood veneer and the grain of the wood in the exterior layer of veneer extends longitudinally of said tube.

4. The combination of claim 1 wherein said reinforcing layer is made of inorganic material.

5. The method of covering a support member with a wooden tube comprising:

forming a tube of multiple layers of wood veneer with a reinforcing layer adjacent to the outer layer of veneers, cutting said tube through all of said multiple layers of veneer to form a first slit extending the full length of said tube, cutting said tube through all except the outer layer of said multiple layers of veneer and said reinforcing layer to form a second slit diametrically opposite to said first slit to act as a hinge, opening said wooden tube at said first slit by hinging at said second slit sufficiently to receive said support member, positioning said tube around said support member and closing said tube, and fastening opposite edges of said first slit together to maintain said tube in a closed position.

6. The method of claim 5 wherein said reinforcing layer is formed of a sheet of inorganic material.

7. The method of forming a tubular enclosure for covering a support member, comprising:

forming a tube of multiple layers of wood veneer and a reinforcing layer adjacent to the outer layer of veneer, all of said layers being bonded together, cutting said tube through all of said layers of veneer for the full length of said tube to form a first slit, and cutting said tube through all except said outer layer of veneer and said reinforcing layer for the full length of said tube and diametrically opposite to said first slit to form a second slit acting as a hinge to permit opening of said tube at said first slit to receive a support member to be enclosed.

8. The method of claim 7 wherein said reinforcing layer is formed of a thin sheet of inorganic material.

* * * * *